US007910066B2

(12) United States Patent
Potts et al.

(10) Patent No.: US 7,910,066 B2
(45) Date of Patent: Mar. 22, 2011

(54) PLATE PLATFORM WITH VISUAL INDICATOR

(75) Inventors: Jay D. Potts, Columbia, SC (US); Conrad Michael Gore, W. Columbia, SC (US)

(73) Assignee: University of South Carolina, Columbia, SC (US)

( * ) Notice: Subject to any disclaimer, the term of this patent is extended or adjusted under 35 U.S.C. 154(b) by 540 days.

(21) Appl. No.: 12/098,058

(22) Filed: Apr. 4, 2008

(65) Prior Publication Data

US 2009/0253195 A1 Oct. 8, 2009

(51) Int. Cl.
*B01L 9/06* (2006.01)

(52) U.S. Cl. ..... 422/102; 435/305.2

(58) Field of Classification Search ..... 422/102, 422/916

See application file for complete search history.

(56) References Cited

U.S. PATENT DOCUMENTS

| | | | | |
|---|---|---|---|---|
| 5,110,556 | A * | 5/1992 | Lyman et al. | 422/101 |
| 5,948,363 | A * | 9/1999 | Gaillard | 422/102 |
| 6,044,876 | A * | 4/2000 | Ally et al. | 141/130 |
| 6,663,836 | B1 * | 12/2003 | Kalmakis et al. | 422/104 |
| 7,776,609 | B2 * | 8/2010 | Pastel et al. | 436/165 |
| 2005/0072030 | A1 * | 4/2005 | Wu | 40/324 |

* cited by examiner

*Primary Examiner* — Christina Johnson
*Assistant Examiner* — Robert Warden
(74) *Attorney, Agent, or Firm* — Dority & Manning, P.A.

(57) ABSTRACT

A plate platform having a visual indicator that allows the user to track his or her progress in loading the platform wells is generally disclosed. The plate platform is constructed from a substantially transparent base having a plurality of elongated bore-holes internally from the side surface in the substantially transparent base. The substantially transparent base defines a non-transparent portion on the top surface extending from the side surface to an area configured to receive the well plate. A slide bar is positioned slideably positioned within each elongated bore-hole of the substantially transparent base. Each slide bar defines a marked surface that is visible through the substantially transparent base but not through the non-transparent portion. The marked surface comprises a row label, a column label, and a well marker.

14 Claims, 5 Drawing Sheets

PLATE PLATFORM WITH VISUAL INDICATOR

BACKGROUND OF THE INVENTION

In recent years, various areas of research have demanded cost-effective assays and reactions of diminishing scale, increasing efficiency and accuracy, with high-throughput capacity. Multi-well devices with multiple individual wells, such as multi-well plates or multi-well blocks, are some of the most commonly used tools to carry out such reactions and assays. A variety of multi-well arrangements, constructed according to standardized formats, are commercially available. For example, a multi-well device having ninety-six depressions or wells arranged in a 12×8 array is a commonly used arrangement.

For example, nucleic acid amplification and detection are among the most valuable techniques used in biological research today. Scientists in all areas of research rely on these methods for a wide range of applications. For some applications, qualitative nucleic acid detection is sufficient. Other applications, however, demand a quantitative analysis.

Presently, conventional polymerase chain reaction ("PCR") detects the amplified product (commonly referred to as the "amplicon") by an end-point analysis by running DNA on an agarose gel after the reaction has finished. In contrast, real-time PCR allows the accumulation of amplified product to be detected and measured as the reaction progresses, that is, in "real-time." Realtime detection of PCR products is made possible by including in the reaction a fluorescent molecule that reports an increase in the amount of DNA with a proportional increase in fluorescent signal. The fluorescent chemistries employed for this purpose include DNA-binding dyes and fluorescently labeled sequence-specific primers or probes. Specialized thermal cyclers equipped with fluorescent detection modules are used to monitor the fluorescence as amplification occurs. The measured fluorescence reflects the amount of amplified product in each cycle.

The ability to accurately reproduce small amounts of reaction mixes for real-time PCR is crucial for the overall success of the experiment. Almost all real-time PCR reactions are done in well plates that fit into the actual PCR machine. Even though there are numerous manufactures of these machines that all use a similar 96 well platform having 96 wells configured in 8 rows of 12 wells.

To ensure that each well is receiving the correct addition of reaction mix, the pipetor must be extremely careful to add the correct amount of reaction mix and into the correct well. This process requires the pipetor's undivided concentration to ensure the wells are loaded properly. However, in the conventional well platforms, there is no indicator to show the pipetor his or her progress in loading the wells on the platform.

As such, a need currently exists for a PCR platform that has a visual indicator allowing the pipetor to track the loading progress of the platform that does not affect or interfere with the reaction progress.

SUMMARY OF THE INVENTION

Objects and advantages of the invention will be set forth in part in the following description, or may be obvious from the description, or may be learned through practice of the invention.

In general, the present disclosure is directed toward a plate platform for use with a well plate having a plurality of wells. The plate platform is constructed from a substantially transparent base having a plurality of elongated bore-holes internally from the side surface in the substantially transparent base. The substantially transparent base defines a non-transparent portion on the top surface extending from the side surface to an area configured to receive the well plate. A slide bar is positioned slideably positioned within each elongated bore-hole of the substantially transparent base. Each slide bar defines a marked surface that is visible through the substantially transparent base but not through the non-transparent portion. The marked surface comprises a row label, a column label, and a well marker.

The slide bar can be proportioned such that when the well marker is located under a particular well, the corresponding column label for that particular well is adjacent to the side surface of the base to be visible outside of the elongated bore-hole.

A fitting mechanism (e.g., a protrusion and aperture coupling) can be included within the elongated bore-hole of the plate platform and/or the slide bar such that the well marker of each slide bar is positioned under a well of the well plate.

Other features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification, which includes reference to the accompanying figures, in which.

Figure 1:
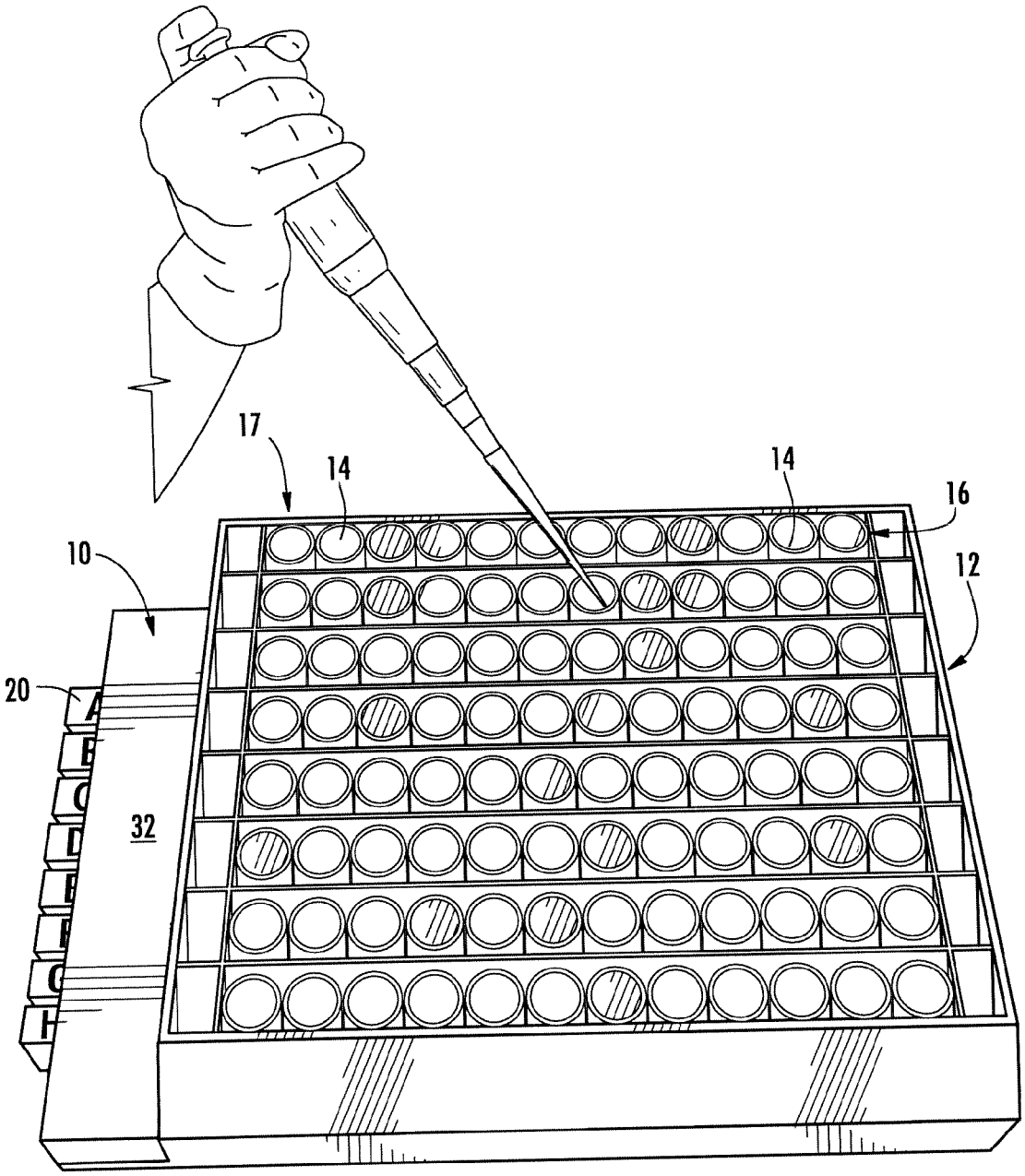
FIG. 1 depicts a well plate positioned on an exemplary plate platform constructed according to one embodiment of the present invention.

Repeat use of reference characters in the present specification and drawings is intended to represent the same or analogous features or elements of the present invention.

DETAILED DESCRIPTION

Reference now will be made to the embodiments of the invention, one or more examples of which are set forth below. Each example is provided by way of an explanation of the invention, not as a limitation of the invention. In fact, it will be apparent to those skilled in the art that various modifications and variations can be made in the invention without departing from the scope or spirit of the invention. For instance, features illustrated or described as one embodiment can be used on another embodiment to yield still a further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied exemplary constructions.

In general, the present disclosure is directed to a plate platform (e.g., a PCR plate platform) having a visual indicator that allows the user to track his or her progress in loading the platform wells. Through the use of the plate platform of the present application, a user can more confidently load each well of a well plate positioned on the plate platform. Specifically, through proper use of the plate platform, errors in loading the wells of the well plate can be more easily avoided. Thus, the efficiency and accuracy of the well loading process can be increased.

A plate platform 10 having a visual indicator allowing the user to track his or her progress is generally disclosed. A well plate 12 can be positioned over the plate platform 10. The plate platform 10 allows a user to track his or her progress through the use of visual cues. Thus, the user can confidently load all of the wells 14 on the well plate 12, while minimizing his or her worry over skipping over or double loading a particular well 14.

The plate platform 10 is configured for use with a well plate 12. Specifically, the well plate 12 is positioned on the top surface 18 of the plate platform 10. As shown in FIG. 1, the well plate 12 has ninety-six wells arranged in eight rows 16, each row having twelve wells, as is commonly found in commercially available well plates 12. However, a plate platform for use with a well plate having any number of wells can be formed in accordance with the disclosures herein. Thus, the dimensions and characteristics of the plate platform depend on the number of wells and the layout of those wells on the well plate.

The plate platform 20 of the present invention defines a plurality of elongated bore-holes 11 extending internally within the plate platform. Each elongated bore-hole 11 is configured to receive a slide bar 20. In the shown embodiment, the elongated bore-holes 11 internally extend horizontally from the side 22 across the length of the plate platform 20 in the x-direction. Each elongated bore-hole 11 is positioned such that a slide bar 20 will be positioned under each row 16 of wells 14 on the well plate 12. The elongated bore-holes 11 can extend the entire length of the plate platform 20, or just the length required for full function of the slide bar as described below.

Slide bars 20 can be moved horizontally in and out of (e.g., slideably moved within) the elongated bore-holes in the side 22 of the plate platform 10. In the shown embodiment, the side bars 20 of the plate platform 10 are configured to correspond to the rows 16 of wells 14 on the well plate 12. Thus, the number of side bars 20 is the same as the number of rows 16 of wells 14 on the well plate 12 (e.g., eight slide bars 20(*a*)-20(*h*) in the shown embodiment). When the well plate 12 is positioned on the plate platform 10, the slide bars 20 are located such that each slide bar 20 is located under each row 16 of the well plate 12. The slide bars 20 are movable within the plate platform 10 in the direction of the rows 16 of the well plate 12.

Figure 2:
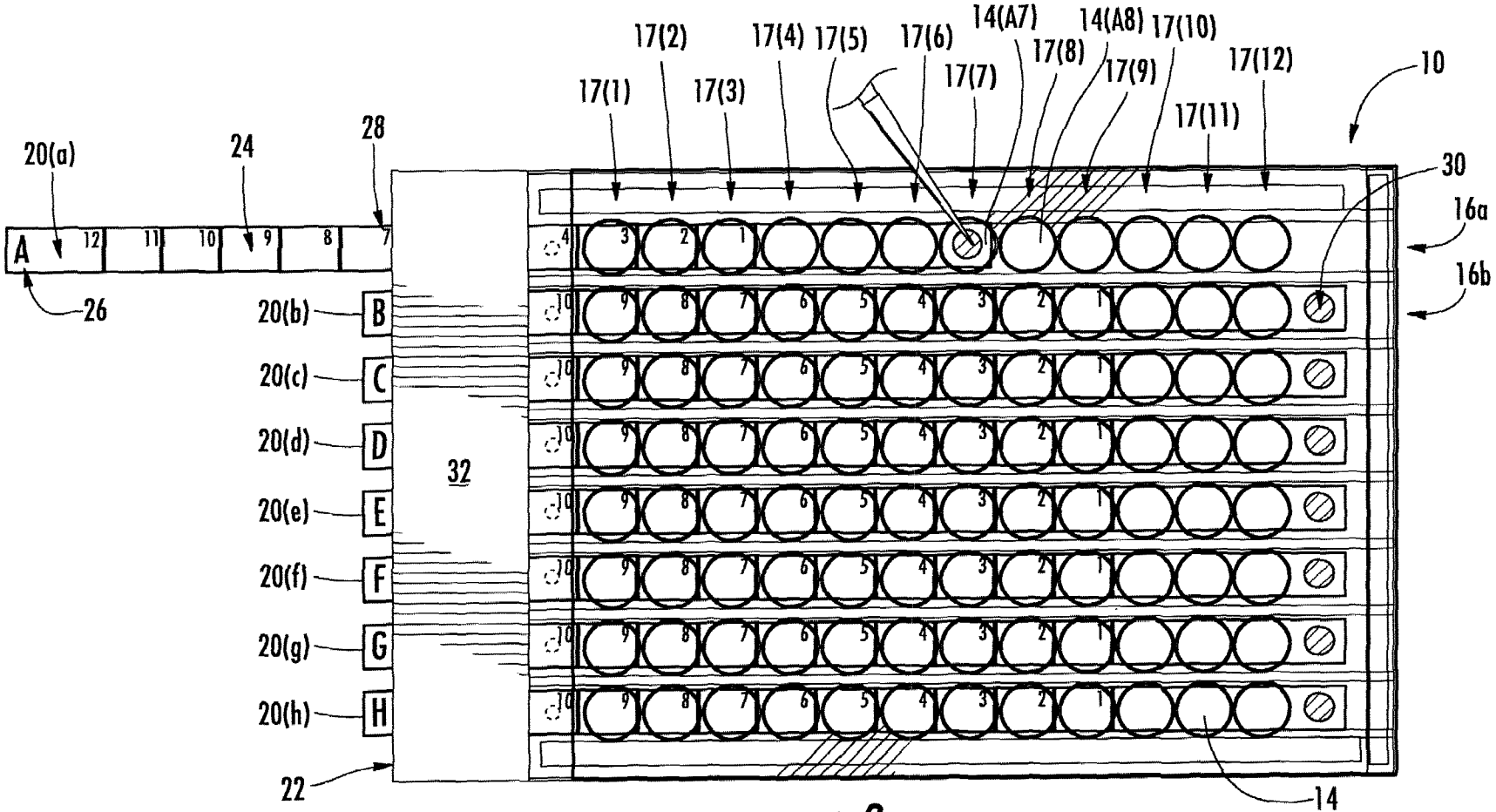
FIG. 2 depicts a top view of the plate platform shown in FIG. 1 in use according to one embodiment of the present invention.
Figure 3:
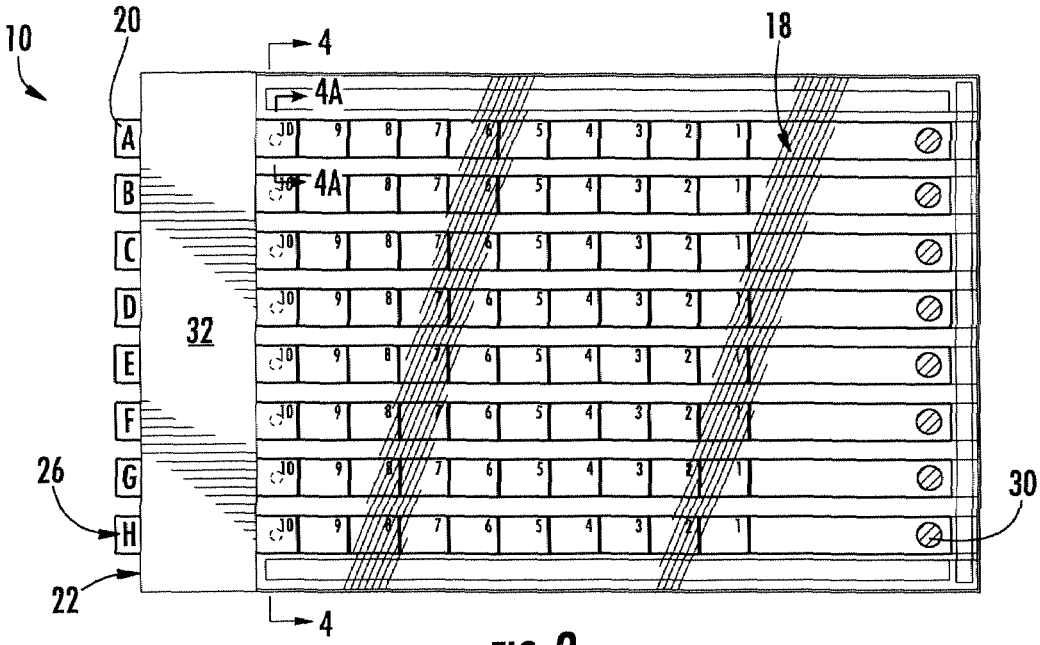
FIG. 3 depicts a top view of the plate platform of FIG. 1 without the well plate.

Each slide bar 20 is labeled on its marked surface 24. For example, each slide bar 20 has a row label 26 that corresponds to the particular row 16 of wells 14 on the well plate 12 under which the slide bar 20 is positioned. This row label 26 can correspond to the markings (not shown) on the well plate 12. For example, in one particular embodiment where there are eight rows 16 of wells 14, the rows 16 on the well plate 12 are marked using the alphabetical letters A-H. Thus, each slide bar 20 of the plate platform 10 has a row label 26 that matches the corresponding row 16 on the well plate 12. FIG. 2 shows that the slide bars 20 are positioned on the plate platform 10 such that their row labels 26 are in alphabetical order A-H to correspond to each row 16 of wells 14 on the well plate 12. The slide bar 20 can be configured such that the row label 26 generally remains visible outside of the elongated bore-holes of the plate platform 10 to remain visible at all times. Additionally, the exposed portion of the slide bar 20 defining the row label 26 can provide a tab for the user to manually move the slide bar 20 in and out of the elongated bore-hole.

Each slide bar 20 also has column labels 28. The number of column labels 28 corresponds to the number of columns 17 of wells 14 on the well plate 12. For example, in the specific embodiment discussed above where there are eight rows 16 of wells 14 on a standard well plate 12 having ninety-six wells 14, there are twelve columns 17 on each well plate 12. Each column 17 has eight wells 14, one from each row 16. Typically, the columns 17 on the well plate 12 are numbered 1-12. Thus, each slide bar 20 of the plate platform 10 has column labels 28 that match the corresponding columns 17 on the well plate 12.

Additionally, each slide bar 20 has a well marker 30 found at the end opposite the row label 26 on the marked surface 24 of the slide bar 20. By moving the slide bar 20 an appropriate distance in and out of the side 22 of the plate platform 10, a user can track the progress of loading the well. Specifically, the slide bar 20 is proportioned so that when the slide bar is partially inserted into the plate platform 10, the row label 26 and the column label 28 adjacent to the side 22 correspond to the well 14 under which the well marker 30 is positioned.

For example, referring to FIG. 2, the slide bar 20(*a*) is only partially inserted into the side 22 of the plate platform 10. The closest exposed column label 28(A7) indicates to the user the location of the well marker 30. In this example, the well marker 30 is located under the seventh well of row A on the well plate 12. Thus, the user can load (e.g., through a pipette) the desired components (e.g., compounds, reaction components, samples, etc.) in the appropriate well. After loading the appropriate well, in this example well 14(A7), the well marker 30 of the slide bar 20(*a*) can be repositioned under the well 14(AB) in the next column 17(8) so that the user can proceed with loading the next well in an organized and easily tracked process.

This loading process can be performed for each row 16 by positioning the well marker 30 under the well 14(A1), loading the well 14(A1), repositioning the well marker 30 under the well 14(A2), loading the well 14(A2), and so on until all wells 14 of each row 16 are loaded. This process allows for the sequential loading of all wells 14 on the well plate 12, while reducing the amount of concentration needed from the user during the process. In other words, this process provides a visual cue to the user as to which well 14 to load next, which can effectively decrease the required intensity of the user's concentration.

The top portion of the plate platform 10 is constructed of a substantially transparent material such that the slide bars 20 positioned within the plate platform 10 can be viewed through the top surface 18 of the plate platform 10. Additionally, the plate platform 10 has sufficient strength to support a well plate 12 positioned on top of it. In order for the plate platform 10 to function properly, both the top surface 18 of the plate platform 10 and the well plate 12 are constructed to be substantially transparent. As such, the marked surface 24 of the slide bars 20 is visible through the top surface 18 of the plate platform 10 and the well plate 12.

However, the plate platform 10 includes a non-transparent portion 32 that is configured to extend substantially from the side edge 13 of the well plate 12 to the side 22 of the plate platform 10. This non-transparent portion 32 prevents the marked surface 24 of the slide bars 20 to be seen in this region. Without this non-transparent portion 32, a column label 28 of the marked surface 24 on the slide bar 20 would be seen at the side edge 13 of the well plate 12, which could confuse the user as to which well is to be loaded. Thus, the user can easily see that the appropriate column label 28, which is adjacent to the side 22 of the plate platform 10, indicating which column the well 14 to be loaded is located. The inclusion of this non-transparent portion 32 extending from the side 22 to the position where the well plate 12 will be positioned helps prevent confusion by the user as to which well is to be loaded next.

Figure 4:
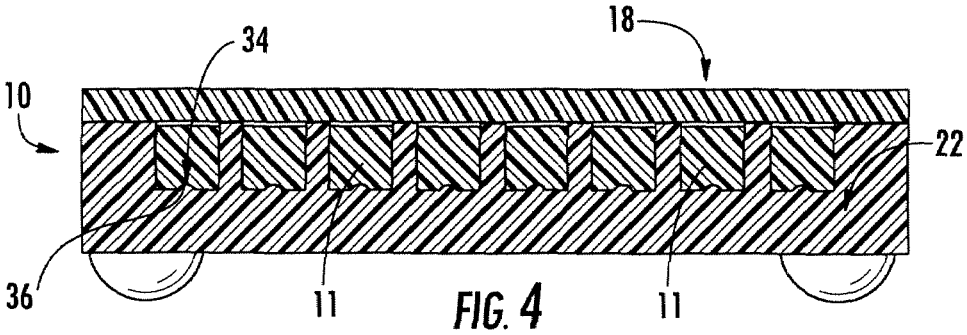
FIG. 4 depicts a side view of the plate platform shown in FIG. 3.
Figure 4A:
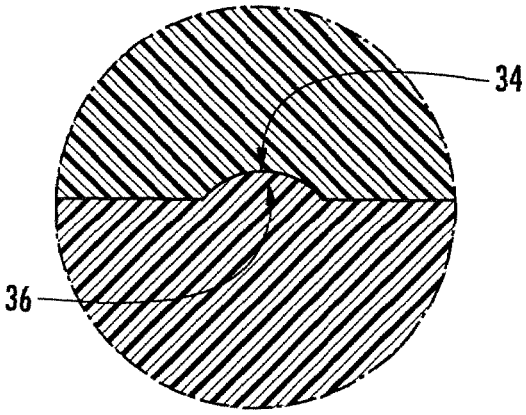
FIG. 4A is an expanded view of an exemplary fitting mechanism between the slide bar and elongated bore-hole of the plate platform of FIG. 3.
Figure 5:
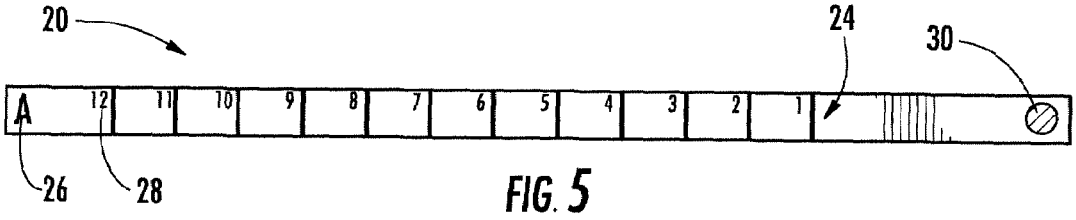
FIG. 5 is a top view of an exemplary slide bar for use with the plate platform of the present invention.
Figure 6:
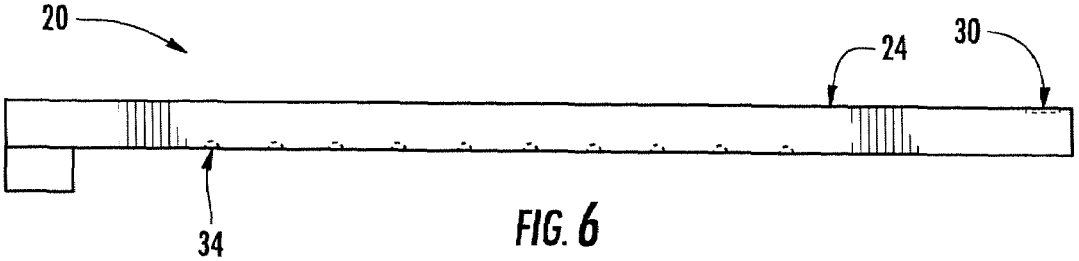
FIG. 6 is a side view of the exemplary slide bar shown in FIG. 5.
Figure 7:
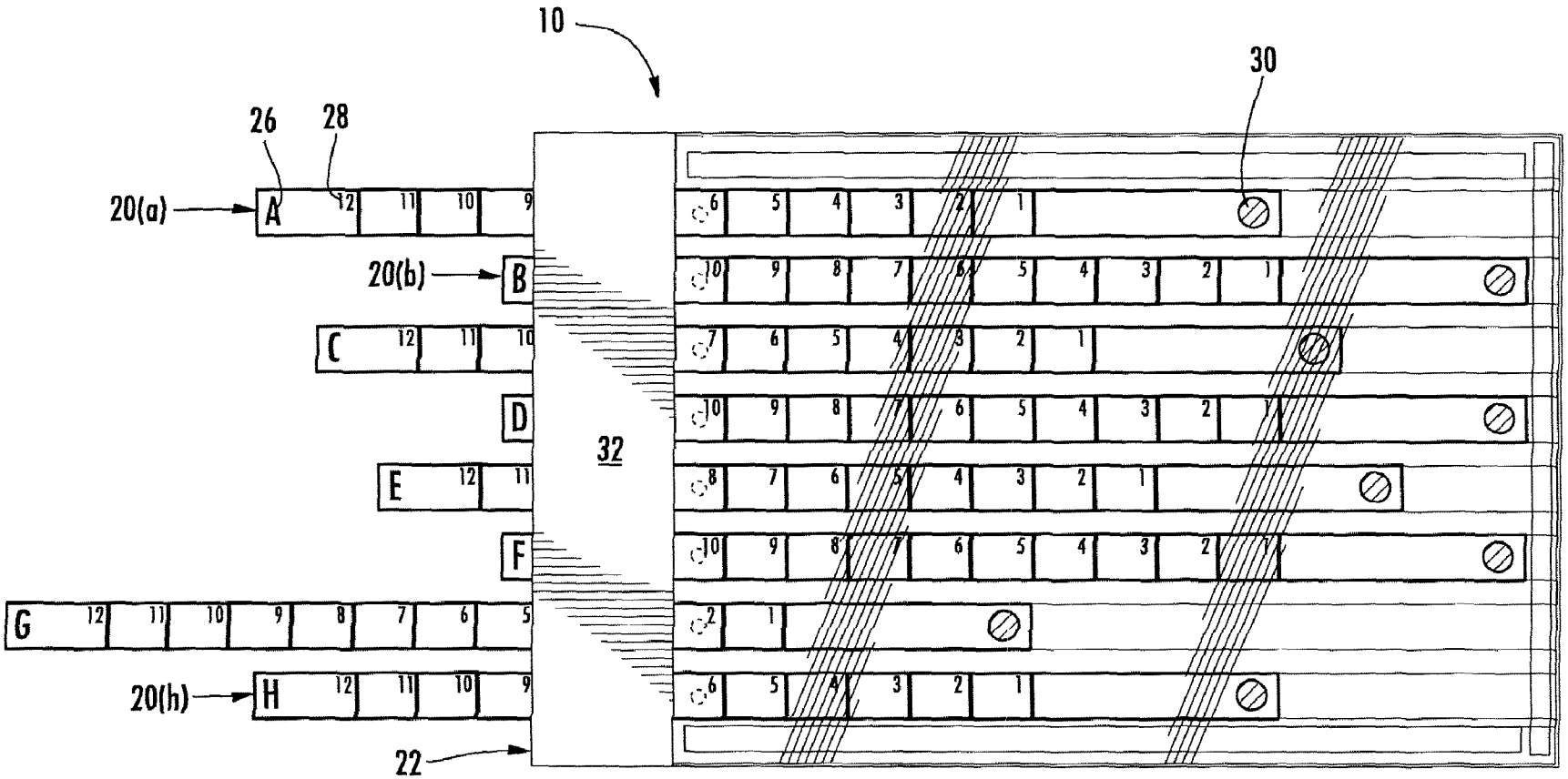
FIG. 7 is a top view of the plate platform of FIG. 3 depicting the slidability of each slide bar within the elongated bore-holes of the plate platform of FIG. 3.

As discussed above, each slide bar 20 can be constructed to slide in and out of the plate platform 10. In one embodiment, a mechanism can be included in the construction of the plate platform 10 and/or slide bar 20 to facilitate the extent of movement in and out of the plate platform 10. For example, a mechanism configured to fit the slide bar 20 at the desired positions (e.g., such that the well marker 30 is positioned under each well) can be found on the plate platform 10 and/or slide bar 20. Referring to FIGS. 4 and 4*a*, each slide bar 20 can be fitted with a plurality of apertures 34 on the backside of the slide bar 20. The number of apertures 34 on the slide bar 20 is the same as the number of column labels 28. Also, a protrusion 36 is located within the elongated bore-hole 11 of the plate platform 10. The size of the protrusion 36 is configured to match the size of the aperture 34 on the slide bar 20, and creates a coupling when positioned together. When moved in and out of the plate platform 10, the slide bar 20 is slightly inhibited from movement at each fitting. The position of the protrusion 36 within the elongated bore-hole 11 and the position of each aperture 34 on the slide bar 20 is configured such that the slide bar is slightly inhibited from movement when the well marker 30 is positioned under each well 14. Thus, the user can easily move the slide bar 20 in and out of the plate platform 10, one well positioning at a time.

Of course, the placement of the protrusions and apertures shown in FIGS. 4 and 4A can be reversed (e.g., the protrusions can be found on the slide bar, and the aperture can be found on the plate platform). Also, the positioning of the protrusions and apertures on the slide bar and plate platform can vary, as long as each fitting formed corresponds to the proper placement of the well marker. Any other mechanism for fitting the slide bar 20 at the desired positions (i.e., such that the well marker 30 is positioned under each well) can be found on the plate platform 10 and/or slide bar 20.

The well plate 12 can be, in one embodiment, removably secured into place on the plate platform 10 by any mechanism. For example, the edges of the well plate 12 can snap into fittings (not shown) located on the top surface 18 of the plate platform 10. The fittings can be protrusions extending from the top surface 18 in a manner such that the well plate 12 securely fits within the area defined by the protrusions to snap into place. Alternatively, the well plate 12 can be adhered to the plate platform 10 through an adhesive (e.g., clear tape). In yet another embodiment, the well plate 12 can be secured to the plate platform through the use of hook and loop fasteners. Of course, any other method of securing the well plate 12 to the plate platform 10 can be utilized.

These and other modifications and variations to the present invention may be practiced by those of ordinary skill in the art, without departing from the spirit and scope of the present invention, which is more particularly set forth in the appended claims. In addition, it should be understood the aspects of the various embodiments may be interchanged both in whole or in part. Furthermore, those of ordinary skill in the art will appreciate that the foregoing description is by way of example only, and is not intended to limit the invention so further described in the appended claims.

What is claimed:

1. A plate platform for use with a well plate having a plurality of wells oriented in rows and columns, the plate platform comprising:

a substantially transparent base defining a top surface and a side surface, wherein a plurality of elongated bore-holes extend from the side surface internally in the substantially transparent base, wherein the substantially transparent base defines a non-transparent portion on the top surface extending from the side surface to an area configured to receive the well plate; and a plurality of slide bars such that one slide bar is configured to be moveably positioned within each elongated bore-hole of the substantially transparent base, wherein each slide bar defines a marked surface that is visible through the substantially transparent base but not through the non-transparent portion, wherein the marked surface comprise a row label, a column label, and a well marker.

2. A plate platform as in claim 1, wherein the elongated bore-holes extend horizontally within the substantially transparent base.

3. A plate platform as in claim 2, wherein the marked surface of the slide bar defines a plurality of column labels.

4. A plate platform as in claim 3, wherein the slide bar is proportioned such that when the well marker is located under a particular well, the corresponding column label for that particular well is adjacent to the side surface of the transparent base to be visible outside of the elongated bore-hole.

5. A plate platform as in claim 1 further comprising a substantially transparent well plate positioned on the top surface of the plate platform, wherein the well marker of each slide bar is visible through the substantially transparent base and the well plate.

6. A plate platform as in claim 5, wherein the substantially transparent well plate is removably secured on the top surface of the plate platform.

7. A plate platform as in claim 6 further comprising a fitting mechanism such that the well marker of each slide bar is positioned under a well of the well plate.

8. A plate platform as in claim 6, wherein the fitting mechanism comprises a protrusion and aperture coupling.

9. A plate platform for use with a well plate having ninety-six wells oriented in eight rows of twelve wells, the plate platform comprising:

a substantially transparent base defining a top surface and a side surface, wherein eight elongated bore-holes extend horizontally from the side surface internally in the substantially transparent base, each elongated bore-hole configured to extend under a row of wells on the well plate, wherein the substantially transparent base defines a non-transparent portion on the top surface extending from the side surface to an area configured to receive the well plate; and eight slide bars defining a marked surface that is visible through the substantially transparent base but not through the non-transparent portion, wherein one slide bar is fitted into each elongated bore-hole defined by the substantially transparent base, wherein the marked surface comprise a row label, twelve column labels, and a well marker.

10. A plate platform as in claim 9, wherein the row label of each slide bar comprises a letter, the letter of each slide bar being different and alphabetically sequential, and wherein the eight slide bars are oriented in the eight elongated bore holes of the substantially transparent base such that the slide bars are sequentially positioned according to its respective row label.

11. A plate platform as in claim 9, wherein the twelve column labels comprises numbers sequentially oriented along the marked surface of the slide bar.

12. A plate platform as in claim 11, wherein the slide bar is proportioned such that when the well marker is located under a particular well of the well plate, the corresponding column label for that particular well is adjacent to the side surface of the transparent base to be visible outside of the elongated bore-hole.

13. A method of sequentially loading wells of a well plate, the method comprising:

providing a plate platform defining a top surface and a side surface, wherein a plurality of elongated bore-holes extend from the side surface internally in the substantially transparent base, wherein the substantially transparent base defines a non-transparent portion on the top surface extending from the side surface to an area configured to receive the well plate; positioning a well plate on the top surface of the plate platform, wherein the well plate defines a plurality of wells;

positioning a slide bar in each elongated bore-hole, wherein each slide bar defines a marked surface that is visible through the substantially transparent base but not through the non-transparent portion, wherein the marked surface comprise a row label, a column label, and a well marker;

sliding the slide bar to a position such that the well marker is located under the well to be loaded and the column label adjacent to the nontransparent portion of the top surface on the plate platform corresponds to the well wherein the well marker is located;

loading the well under which the well marker is located with a sample.

14. A method as in claim 13, further comprising:

sliding the slide bar such that the well marker is positioned under the well adjacent to the loaded well.

* * * * *